United States Patent [19]

Balbach et al.

[11] 4,296,570

[45] Oct. 27, 1981

[54] HYDRAULIC DOOR OPERATOR

[75] Inventors: George C. Balbach, Lake Forest, Ill.; Robert J. Peterman, Cedarburg, Wis.

[73] Assignee: Arthur Smith Industries, Inc., Milwaukee, Wis.

[21] Appl. No.: 73,275

[22] Filed: Sep. 7, 1979

[51] Int. Cl.[3] ..... E05F 15/02

[52] U.S. Cl. ..... 49/360; 49/137; 60/476

[58] Field of Search ..... 49/264, 360, 334, 118, 49/123, 137; 91/420; 60/476, 473

[56] References Cited

U.S. PATENT DOCUMENTS

| | | | |
|---|---|---|---|
| 2,276,338 | 3/1942 | Potter . | |
| 2,298,542 | 10/1942 | Potter . | |
| 2,556,531 | 6/1951 | Goodwin . | |
| 2,911,210 | 11/1959 | Ferguson . | |
| 3,018,902 | 1/1962 | Minty | 91/420 X |
| 3,319,380 | 5/1967 | Loftus . | |
| 3,323,255 | 6/1967 | Sweetland, Jr. et al. | 49/264 |
| 3,344,555 | 10/1967 | Augle | 60/476 X |
| 3,903,698 | 9/1975 | Gellatly et al. | 60/476 X |
| 3,938,282 | 2/1976 | Goyal . | |
| 4,034,918 | 7/1977 | Calbertson et al. | 60/476 X |

*Primary Examiner*—Kenneth Downey
*Attorney, Agent, or Firm*—Quarles & Brady

[57] ABSTRACT

An automatic door operator for opening and closing a door such as a cold storage door which is mounted in a frame for sliding movement in a vertical plane has a hydraulic control system which includes an electric motor for rotating a reversible hydraulic pump, an electric control circuit which activates the electric motor to rotate the pump in the appropriate direction, and a reversible rotary hydraulic motor driven by the pump to rotate a chain drive which draws the door to its open and closed positions. The hydraulic control system also includes a means for cushioning the rapid start and stop of the door to provide smooth operation which includes a pair of check valves disposed in the control system such that one check valve is on either side of the hydraulic pump, and a first set of pressure relief valves disposed in the control system on either side of the pump between the pump and the check valves, and a second set of pressure relief valves between the check valves and the hydraulic motor. The check valves provide a locking mechanism for the door so that when the flow of hydraulic fluid from the pump stops, the door is locked in its open or closed position.

14 Claims, 5 Drawing Figures fig. 2
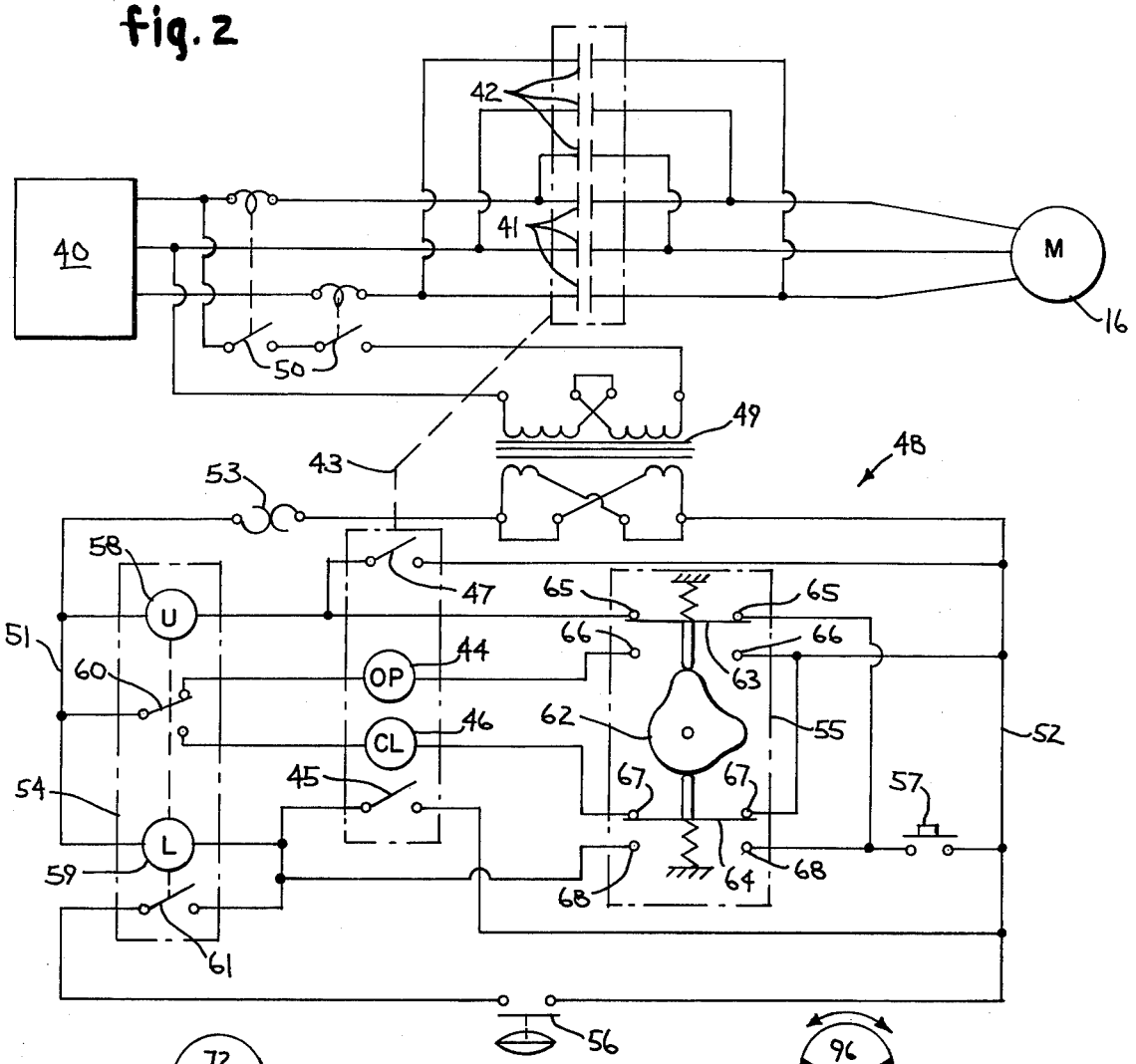
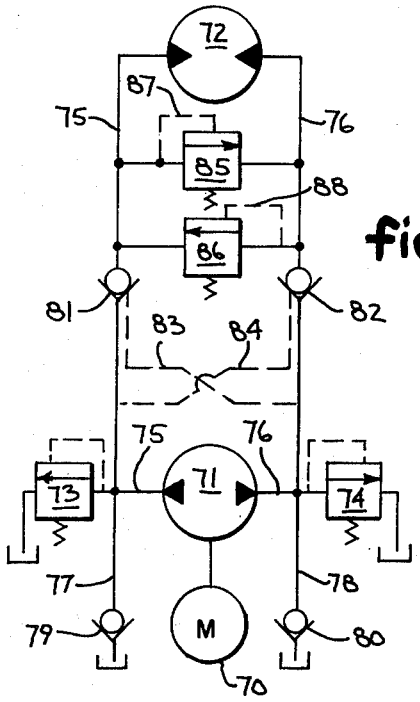
fig. 3
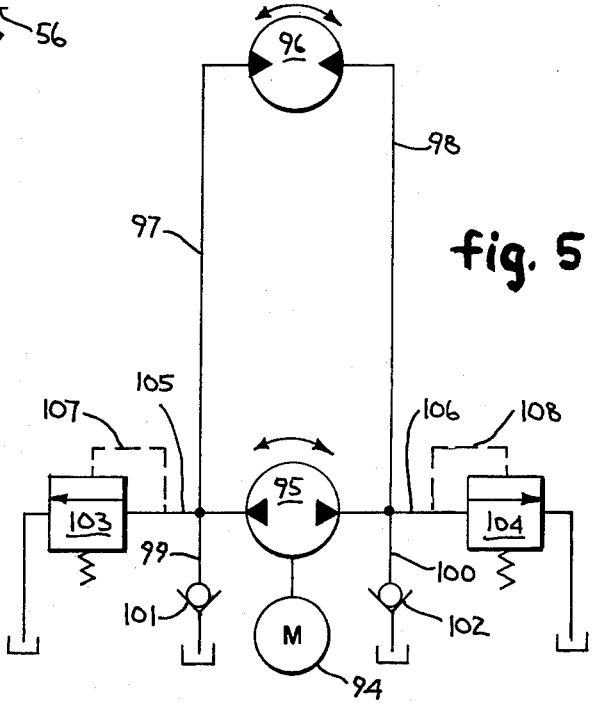
fig. 5

HYDRAULIC DOOR OPERATOR

BACKGROUND OF THE INVENTION

This invention relates to automatic door operators for cold storage doors and the like having a hydraulic control system which provides a smooth operation at relatively high door speeds.

Automatic door operators are used to open and close doors which are mounted for swinging or sliding movement between open and closed positions. These doors, especially those available for cold storage purposes, are usually of the single panel or the bi-parting sliding type which include electro-mechanical drive systems comprised of a chain loop above the doors which is used to draw the doors between open and closed positions with an electric motor for driving the chain. The electric motor is controlled by an electric circuit which provides for the powering of the motor in the appropriate direction during the door opening and closing cycle. Electro-mechanical systems, however, may have a relatively short service life and must be frequently adjusted to compensate for the wearing of components. Also, this type of system may develop a sudden surge of torque from the electric motor upon start-up, and can also abruptly stop the motor when the door is fully opened or closed to result in undesirably rapid accelerations and decelerations that lack smoothness of operation.

There have also been provided hydraulic control systems for automatic door operators. U.S. Pat. No. 3,319,380 issued to Loftus for "Automatic Door Operator" shows a hydraulic system for opening and closing double swinging doors. He shows a pump driven by an electric motor which pumps hydraulic fluid from a reservoir through a check valve to an accumulator. From the accumulator fluid is fed through one of two electrically controlled valves to either of two hydraulic door operators. Loftus also shows an electric control circuit for controlling door operation. This type of hydraulic system, however, may be relatively slow for opening and closing cold storage doors which must be opened and closed rapidly to limit energy losses through the doorway.

It is also commonplace to use hydraulic or fluid cylinder-piston arrangements for operating doors that move in the plane of the door. For example, U.S. Pat. No. 3,619,946 issued to Crocker for "Automatic Door Operator" and U.S. Pat. No. 3,938,282 issued to Goyal for "Sliding Door Operator" show pneumatic operation in which a drive piston is slideably moveable within a cylinder upon actuation of a sensing device to open and close the doors. U.S. Pat. No. 2,298,542 issued to Potter et al. for "Door Operator" also discloses a hydraulic system for operating a reciprocal piston arrangement for a door. However, the drive pistons within the cylinders of the above arrangements match full door movement in length, and become excessively large for large doors.

The automatic door operator of the present invention includes an improved hydraulic control system which provides for smooth operation at relatively high door speeds by hydraulically cushioning the rapid start and stop of a door. The invention also provides increased service life through the use of hydraulic components that require less maintenance.

SUMMARY OF THE INVENTION

The present invention relates to an automatic door operator for opening and closing a door, and more specifically resides in a hydraulic control system which includes a hydraulic pump for driving a reversible rotary hydraulic motor to open and close the door together with an electric control circuit which activates an electric motor to rotate the pump in the appropriate direction, and a series of check valves and pressure relief valves in the control lines of the hydraulic system. The pressure relief valves may be connected to the control system between the pump and hydraulic motor to provide smooth operation for the door operator by cushioning the acceleration and deceleration in the opening and closing of the door. The check valves provide a locking mechanism for the door, so that when the flow of hydraulic fluid from the pump stops, the door is locked in its open or closed position.

Automatic door operators, for opening and closing doors, especially cold storage doors, operate most efficiently at relatively high speeds. High speed is desirable for a cold storage door since there exists a large temperature differential across its doorway which causes energy losses whenever the door in opened. Thus, such a door should be opened and closed rapidly to limit energy losses. However, door operators run at high speeds may cause the door to abruptly start and stop which results in a lack of smoothness during operation, and also results in the unnecessary wearing of component parts. Smooth operation at relatively high speeds is thus desirable to increase service life and provide a highly efficient system. The present invention seeks to solve these problems by providing a door operator for opening and closing a door which includes a hydraulic control system having a hydraulic pump which drives a reversible rotary hydraulic motor to rotate a chain drive which draws the door to its open and closed positions, a pair of check valves disposed in the system such that one check valve is on either side of the hydraulic pump, a first pair of pressure relief valves one being connected to the system on either side of the pump between the pump and the check valves, and a second pair of relief valves which relieve high pressure in the system and which are connected to the system between the check valves and the hydraulic motor. The first pair of pressure relief valves are appropriately adjusted to reduce the initial peak pressure surge in the system as the pump starts up resulting in smoother acceleration for a door. The second set of pressure relief valves insures the smooth deceleration of the door in either its opening or closing cycle by permitting high pressure to be bypassed around the motor after the pump has shut off. The check valves in the hydraulic system will close and lock hydraulic fluid in the hydraulic motor when it is not being operated. This serves as a brake or locking mechanism to preclude movement of the door when the door is in its open or closed position.

It is an object of the invention to provide an automatic door operator which has smooth operation at relatively high speeds by hydraulically cushioning the rapid start and rapid stop of the opening and closing cycles of a door.

It is another object of the invention to provide a hydraulic control system for an automatic door operator having highly reliable hydraulic components which increase the service life of the system.

It is still another object of the invention to provide an automatic door operator which includes a locking mechanism to assure that when the flow of hydraulic fluid through the system ceases the door is locked in its position.

It is yet another object of the invention to provide an automatic door operator which may be readily adjusted to regulate the opening and closing of a wide range of door sizes and weights.

The foregoing and other objects and advantages of the invention will appear from the following description. In the description, reference is made to the accompanying drawings which form a part hereof, and in which there is shown by way of illustration and not of limitation several embodiments of the invention. Such embodiments do not represent the full scope of the invention, and reference is made to the claims herein for interpreting the breadth of the invention.

BRIEF DESCRIPTION OF THE DRAWINGS

FIG. 2 is a schematic diagram of an electric control circuit for the door operator of FIG. 1;

FIG. 3 is a schematic diagram of a hydraulic door operator constituting a second embodiment of the present invention;

FIG. 5 is a schematic diagram of a hydraulic door operator constituting a fourth embodiment of the present invention.

DESCRIPTION OF THE PREFERRED EMBODIMENTS

Figure 1:
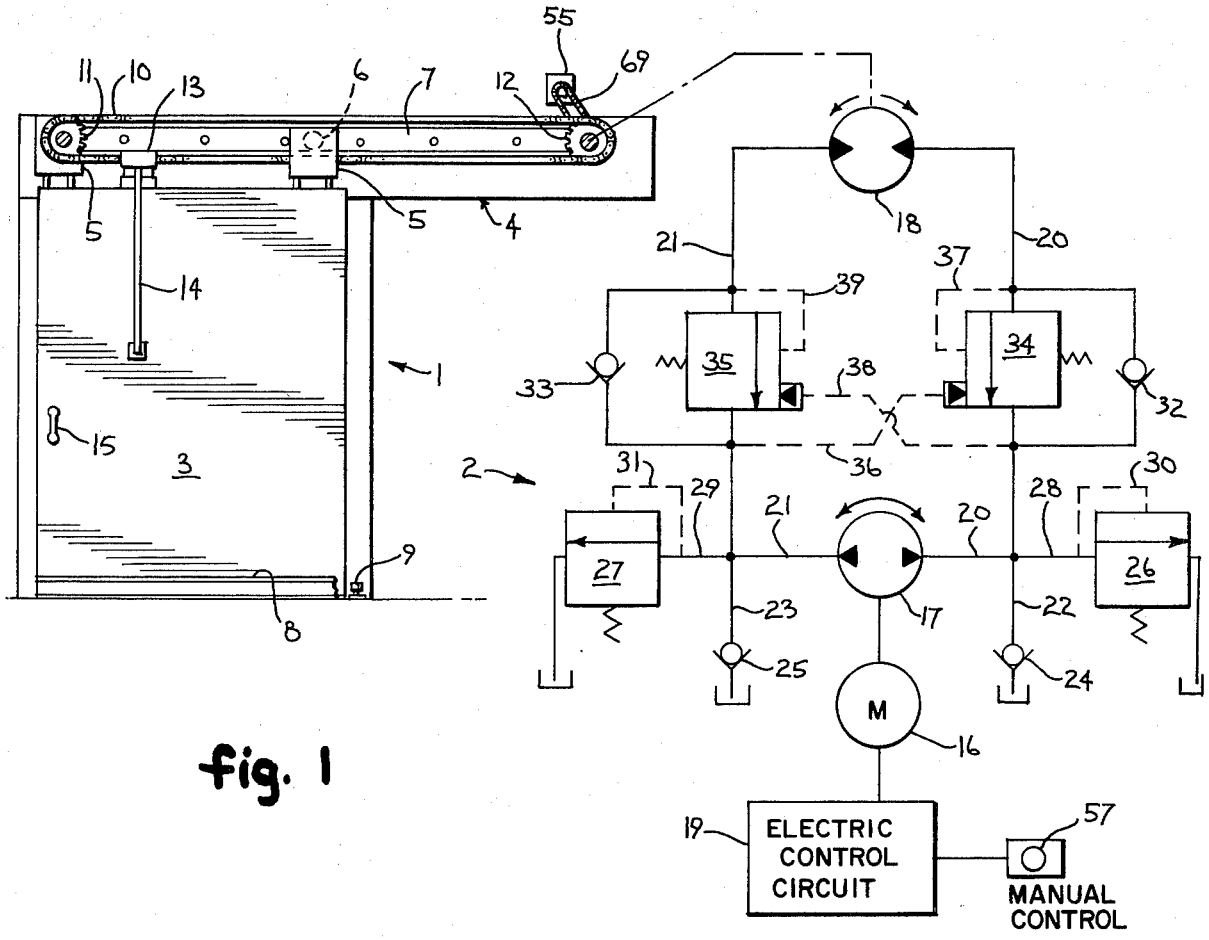
FIG. 1 is a schematic diagram of a hydraulic door operator constituting a preferred embodiment of the present invention.

Referring to FIG. 1, there is shown in schematic form a door assembly 1 on the left hand side of the figure and a hydraulic door operator mechanism 2 on the right hand side. The door assembly 1 includes a door 3, shown in closed position, that is slideably suspended for sideward movement in a vertical plane on a horizontally extending frame 4. The door 3 is hung from the frame 4 on a pair of door trucks 5 that are secured to the top of the door 3. Each truck 5 includes a bearing wheel 6 which runs along a horizontal guide rail 7. The door 3 includes a flange 8 along its bottom edge which turns over a guide wheel 9 mounted on the floor to guide the bottom of the door 3.

Above the door 3 is a drive chain 10 in the form of an endless loop which is used to draw the door 3 between its open and closed positions. The chain 10 is looped around an idler sprocket 11 at one end and a drive sprocket 12 at its other end. The door 3 is connected to the chain loop 10 by means of a chain pick-up clamp 13 that is mounted on the top of the door 3, so that as the chain loop 10 is driven around the sprockets 11 and 12 the door 3 will be drawn sidewardly along the frame 4 to either an open or a closed position. The pick-up clamp 13 may also be disengaged from the drive chain 10 by pulling on a safety release cord 14 which hangs alongside the door 3, and this enables the door 3 to be manually opened and closed independently of the chain drive 10 by pulling on a door handle 15.

The door 3 may be typically a cold storage door of the single panel type, as shown in FIG. 1, or may be a bi-parting door wherein a pair of doors slide horizontally in a vertical plane to part from one another in their opening cycle. The door may also be of the overhead door type. Overhead doors generally are single panel doors which rise vertically to open. Swinging doors can also be used, and the present invention may be employed with any of these various types of doors.

The chain loop 10 is driven by the hydraulic door operator mechanism 2, which includes an electric motor 16, a reversible hydraulic pump 17 and a reversible rotary hydraulic motor 18. The electric motor 16 is controlled by an electric control circuit 19 which is schematically shown in FIG. 2. The electric motor 16 drives the reversible hydraulic pump 17 which pumps hydraulic fluid through the system to drive the hydraulic motor 18, which in turn opens and closes the door 3 by turning the drive sprocket 12 and drive chain 10.

The hydraulic door operator mechanism 2 includes a pair of hydraulic control lines 20 and 21. Control line 20 leads from the right hand side of the pump 17 to the right hand side of the hydraulic motor 18, and control line 21 leads from the left hand side of the hydraulic motor 18 to the left hand side of the pump 17. The mechanism 2 includes a pair of hydraulic input lines 22 and 23, the line 22 leading from a sump to the control line 20, and the line 23 leading from the sump to the control line 21. Disposed in the hydraulic lines 22 and 23 is a pair of check valves 24 and 25, respectively, which permit hydraulic fluid to be drawn from the sump by the pump 17, but prevent hydraulic fluid from passing from the control lines 20 and 21 back to the sump. The hydraulic lines 22 and 23 thus permit the replacement of hydraulic fluid which may be lost from the system, as will hereinafter be understood.

FIG. 1 shows a pair of start cushioning valves 26 and 27 connected to the control lines 20 and 21. These valves 26, 27 are adjustable pressure relief valves and are positioned in the hydraulic system on opposite sides of the pump 17 between the pump 17 and hydraulic motor 18, with valve 26 connected through a line 28 to control line 20 and valve 27 connected through a line 29 to control line 21. The pressure relief valves 26 and 27 include pilot lines 30 and 31, respectively, which sense the pressure in the control lines 20 and 21. If a control line pressure is greater than a predetermined value in either of the lines 20 or 21, the associated valve 26 or 27 opens to relieve the pressure in the control line by bypassing hydraulic fluid to the sump until line pressure drops to a predetermined value. In this manner, the pressure relief valves 26 and 27 are used to reduce the initial peak pressure surge that may develop in the control lines 20 or 21 when the pump 17 is started by the electric motor 16. For example, the maximum peak pressure developed in control line 20 or 21 may rise to 1500 psi and the relief valves 26 and 27 may be adjusted to permit a maximum of 1200 psi, so that the valves 26 and 27 relieve about 300 psi from the control line 20 or 21 at the initial start-up of the pump 17. The valves 26 and 27 may be adjusted depending upon the size and weight of the door 3 so that appropriate pressure settings are matched to the system. This cushions the start-up of the system by providing a more even and constant application of hydraulic pressure in the system so that the door 3 begins to move smoothly in its opening or closing cycle. After starting, the pressures developed by the pump 17 in the lines 20, 21 are of lesser value, and the valves 26, 27 are normally closed after start-up, so that fluid flow is confined from the pump 17 to the motor 18 and back to the pump 17.

FIG. 1 further shows a second set of check valves 32 and 33 disposed in control lines 20 and 21 respectively. These valves 32 and 33 permit hydraulic fluid to pass from the hydraulic pump 17 to the hydraulic motor 18, but not in the reverse direction, and they provide a locking mechanism for the door 3, so that when the flow of hydraulic fluid through the system from the pump 17 stops fluid can not escape from the motor 18, to thereby lock the motor 18 from rotation. The door 3 is then locked in its open or closed position, unless manually disengaged from the drive chain 10 by operation of the clamp mechanism 13, as previously described herein.

Also disposed in the control lines 20 and 21 are a pair of stop cushioning valves in the form of cushion-lock valves 34 and 35. The cushion-lock valves 34 and 35 are disposed in the control lines 20 and 21 in a parallel relationship with the check valves 32 and 33, respectively, and each consists of a combination relief and check valve. The cushion-lock valve 34 includes a pair of pilot lines 36 and 37. The pilot line 36 of cushion-lock valve 34 senses pressure in control line 21 and pilot line 37 senses the pressure in control line 20. The cushion-lock valve 34 acts as a relief valve by sensing the high pressure in control line 21 when the pump 17 is pumping hydraulic fluid through the motor 18 clockwise, as shown in FIG. 1, and moves to the right to permit the fluid to return to the pump 17. The cushion-lock valve 34 also acts to insure smooth stopping of the door 3. This function is provided by the pilot line 37 sensing high pressure in control line 20. When the pump 17 stops, the hydraulic motor 18 will continue to turn for a short time thereafter thus building up pressure in control line 20. The cushion-lock valve 34 senses this pressure through pilot line 37 and moves to the right, as shown in FIG. 1, to permit hydraulic fluid to pass through the valve back to the pump 17. Thus, the hydraulic motor 18 is permitted to rotate for a short time after the pump 17 is stopped to insure smooth stopping of the door 3. When the hydraulic motor 18 finally stops the cushion-lock valve 34 will move to the left and act as an additional check valve in the system. If the cushion-lock valve 34 was not present, the check valve 32 would act to abruptly stop the hydraulic motor 18 thereby abruptly stopping the door 3. Cushion-lock valve 35 with its corresponding pilot lines 38 and 39 acts in an identical manner as valve 34, except that it is operational to insure smooth stopping of the door 3 when the pump 17 is pumping fluid in a counterclockwise direction and driving the hydraulic motor 18 in the reverse direction.

The electic control circuit 19 which controls the electric motor 16 to open and close the door 3 is schematically illustrated in FIG. 2. Three phase power is supplied from a power source 40 to the motor 16 through either the contacts 41 or 42 of an across the line motor starting switch 43 that is outlined in dotted lines. The motor starting switch 43 is of the double coil reversing type, with a door opening coil 44 that closes the contacts 41 and also an auxiliary holding contact 45 when energized, and a door closing coil 46 that closes the contacts 42 and also an auxiliary holding contact 47 when energized. The motor starting switch 43 is operated by a control circuit 48 which is fed by a voltage step down transformer 49 having motor overload relay contacts 50 in its primary side. The transformer 49 reduces the voltage of one phase of the power source 40 to a control voltage level, say for example, from 440 volts to 24 volts. The 24 volts appears across the transformer secondary to feed the control circuit lines 51 and 52, there being a circuit breaker 53 in the line 51.

The control circuit 48 includes a latching relay 54, a rotary limit switch 55, an air edge switch 56, and a manual push button control switch 57. The latching relay 54 includes a pair of relay coils, comprising an unlatched coil 58 and a latched coil 59, a contact 60 which is preferably a double throw switch, and a supplementary contact 61. The unlatched coil 58, and the closing coil 46 are energized to close the door 3, and the latched coil 59 and opening coil 44 are energized to open the door 3.

The rotary limit switch 55 has a cam wheel 62 with two lobes at ninety degrees to one another. The cam wheel 62 operates a pair of movable contacts 63 and 64. The upper contact 63, as seen in FIG. 2, is shown as being held by one cam lobe in engagement with normally open contacts 65, and when the lobe rotates out of the position shown the contact 63 will move into engagement with normally closed contacts 66. Similarly, the lower movable contact 64 engages normally closed contacts 67, and is moved by the other cam lobe into engagement with normally open contacts 68.

As shown in FIG. 1, the limit switch 55 is rotated by an endless loop of chain 69 drive in unison with the drive sprocket 12. Thus, when the drive sprocket 12 is rotated by the hydraulic motor 18 the limit switch 55 also rotates, and the cam lobes of the cam wheel 62 move the contacts 63 and 64 into and out of contact with the stationary contacts 65, 66, 67 and 68 in timed relation to opening and closing the door 3 in order to indicate to the control circuit 48 the door position.

For the purpose of describing the operation of the control circuit 48, the circuit elements in FIG. 2 are shown in position ready to close the door 3. The operator closes the push button 57 of his manual control. This closes a circuit for the relay unlatched coil 58 to cause current to flow from the line 52 through the depressed button 57, the bridged contacts 65 of the limit switch 55, and the coil 58 to the line 51. When the unlatched relay coil 58 is thus energized, contact 60 of the latching relay 54 moves from its upper position, as shown in FIG. 2, to its lower position, so that voltage may be applied to the left hand side of the closing coil 46. The closing coil 46 then becomes energized, since voltage has already been applied to its right hand side through the normally closed contacts 67 of the limit switch 55. When the closing coil 46 is energized it closes the set of three line contacts 42 to apply power to the motor 16.

The push button switch 57 is only temporarily closed by the operator, and then returns to the open position shown in FIG. 2. As a result, continuous current must be supplied to the unlatched coil 58 by some alternative circuit to hold the contact 60 in its lower position, in order to permit continous power to be supplied to the motor 16. This is accomplished by closing the normally open holding contact 47 that is operated by the coil 46. In doing this, current is continously supplied to the unlatched coil 58 to hold the contact 60 in its lower position to permit continuous energization of the closing coil 46.

The control circuit 48 automatically shuts off the motor 16 when the door 3 is closed through the operation of the rotary limit switch 55. When the door 3 is closing, the cam wheel 62 of the rotary limit switch 55 is rotating clockwise as viewed in FIG. 2. This rotation permits the second cam lobe to open the circuit between the normally closed contacts 67 by moving the lower movable contact 64 from the position shown in FIG. 2 downwardly to a position wherein it bridges the normally open contacts 68. During rotation of the cam wheel 62, the first lobe also permitted the upper movable contact 63 to move downwardly from the position shown in FIG. 2 to a position where it bridges the normally closed contacts 66. When the lower movable contact 64 moves downwardly to open the circuit between the normally closed contacts 67 the closing coil 46 of the switch 43 will be deenergized. As a result, the holding contact 47 is opened, and the three line contacts 42 supplying power to the motor 16 are also opened. Thus, power is cut off to the motor 16, and the motor 16 is shut off with the door 3 now in closed position. It should be noted that the interval between the cam lobes of the limit switch 55 must be appropriately adjusted so that the motor 16 will shut off at the desired point in door travel.

To open the door, the operator must once again push the button 57. Since the lower movable contact 64 of the limit switch 55 is now in its lower position bridging the normally open contacts 68 current is supplied to the latched coil 59 for it is now connected through a completed circuit between lines 51 and 52. When the latched coil 59 is energized, it will move the switch 60 of the latching relay 54 from its lower position to its upper position, as shown in FIG. 2. When this occurs, voltage will be applied to the left side of the opening coil 44 of the starting switch 43. The opening coil 44 will thus be energized, since voltage has already been supplied to the right side of the coil 44 through the normally closed contacts 66 of the limit switch 55 by reason of the movable contact 63 having moved to its lower position bridging the normally closed contacts 66. When the opening coil 44 is energized it will close the three line contacts 41 leading to the motor 16. The contacts 41 reverse the phase of the power being supplied to the motor 16, from that when the contacts 42 were closed, which causes the motor 16 to be driven in the opposite direction to which it was driven when closing the door 3. Opening of the door 3 now takes place. Since current must be continuously supplied to the latched coil 59 in order to hold the switch 60 in its upper position, the opening coil 44 also closes its associated holding contact 45, to maintain a closed circuit for the latched coil 59 after the push button 57 reopens. The motor 16 will continue to turn the pump 17 in the direction for door opening.

The rotary limit switch 55 will shut off the motor 16 once the door 3 is completely open. As the door 3 is opening, the cam wheel 62 is rotating in the counterclockwise direction, as shown in FIG. 2. As the wheel 62 rotates, the first cam lobe will push the upper movable contact 63 away from the normally closed contacts 66 to the upper position bridging the normally open contacts 65, as shown in FIG. 2. Also, the lower movable contact 64 moves from its lower position bridging the normally open contacts 68 to its upper position bridging the normally closed contacts 67. When the upper movable contact 63 moves away from the normally closed contacts 66, an open circuit results which deenergizes the opening coil 44 of the switch 43. When the opening coil 44 is deenergized, the holding contact 45 is opened, and the line contacts 41 leading to the motor 16 are also opened. Thus, the current is no longer supplied to the latched coil 59 of the latching relay 51 and the motor 16 is shut off. The control circuit 48 is once again in the position shown in FIG. 2, ready to close the door 3 when the manual push button 57 is depressed by the operator.

The air edge switch 56 is provided in the circuit as a safety feature. Air edge switches are commonly used, and comprise a switch operated pneumatically by air lines placed along a door edge. The air edge switch 56 is only operable when the door 3 is closing or closed, and operates to open the door 3 if an object or the operator is in the path of the moving door 3. When the door 3 is closing and the unlatched coil 58 is energized as described above, this coil 58 closes the relay contact 61 to partially complete a circuit between the lines 51 and 52 which includes the relay latched coil 59. Then, whenever the air edge switch 56 is closed, indicating that something is obstructing the closing of the door 3, the latched coil 59 will be energized to move the switch 60 upwardly to the position shown in FIG. 2. When this occurs, voltage will be applied to the left side of the opening coil 44. Voltage will also be applied to the right side of the opening coil 44, since as the rotary limit switch 55 rotates clockwise when closing the first cam lobe permits the movable contact 63 to drop downwardly and bridge the normally closed contacts 66. The opening coil 44 will thus be energized to close the line contacts 41, and the closing coil 46 will be deenergized causing line contacts 42 to open. This switching action reverses the motor 16 to immediately open the door 3 in response to the air switch 56 detecting an obstruction in the path of the door. Also, continuous current is supplied to the latched coil 59 to hold the switch 60 in its upper position since the opening coil 44 will have closed the contacts 45, as previously described herein. The motor 16 will then drive the pump 17 until the door 3 is completely open and will be shut off by the counterclockwise rotation of the cam wheel 62 of the limit switch 55.

Referring now to FIG. 3, there is shown a second embodiment of the present invention. This embodiment is similar to the first embodiment and includes an electric motor 70, pump 71, hydraulic motor 72, and pressure relief valves 73 and 74 in a closed loop hydraulic circuit. The hydraulic circuit includes a pair of hydraulic control lines 75 and 76. Control line 75 leads from the left hand side of the pump 71 to the left hand side of the motor 72, and control line 76 leads from the right hand side of the motor 72 to the right hand side of the pump 71. The hydraulic circuit includes a pair of hydraulic input lines 77 and 78 leading from a sump to the lines 75 and 76, respectively. Disposed in the input lines 77 and 78 is a pair of check valves 79 and 80 which permit the replacement of hydraulic fluid which may be lost from the system in the same manner as described for the embodiment of FIG. 1. FIG. 3 shows a pair of start cushioning or pressure relief valves 73 and 74 connected to the control lines 75 and 76 on either side of the pump 71. The valves 73 and 74 operate in the same manner as for the first embodiment described herein to relieve initial peak pressures in the control lines 75 and 76, and may be adjusted accordingly so that appropriate pressure settings are matched to the system.

FIG. 3 further shows a second set of check valves 81 and 82 disposed in control lines 75 and 76, respectively. These valves 81 and 82 permit hydraulic fluid to pass from the pump 71 to the hydraulic motor 72, and include pilot lines 83 and 84 which permit the valves 81 and 82 to open upon sensing high pressure in the control line 75 or 76. As a result, if the pump 71 is pumping hydraulic fluid counterclockwise as seen in FIG. 3 through the hydraulic system, the check valve 81 on the inlet side of the pump 71 will sense the pressure in control line 76 on the outlet side of the pump 71 and move to an open position to permit fluid to pass from the motor 72 back to the pump 71. When the pump 71 is pumping fluid in a clockwise direction, the check valve 81 permits fluid to pass through to the motor 72 and the check valve 82 senses the pressure in the outlet side of the pump 71 and opens to permit hydraulic fluid to pass back to the pump 71. When the flow of hydraulic fluid through the system from the pump 71 stops, the valves 81 and 82 act to lock the motor 72 from rotation.

It should be noted that the electric control circuit which controls the electric motor 70 may be like that schematically illustrated in FIG. 2.

Also connected to the control lines 75 and 76 are a pair of stop cushioning or pressure relief valves 85 and 86. The pressure relief valves 85 and 86 are disposed in a parallel relationship with the hydraulic motor 72 and pump 71, and are connected across the control lines 75 and 76 between the check valves 81 and 82 and the hydraulic motor 72. The pressure relief valves 85 and 86 include pilot lines 88 and 89, respectively, which sense the pressure in control lines 75 and 76 to relieve high pressure as necessary to insure smooth stopping of a door by permitting the motor 72 to continue turning after the pump 71 has stopped, as hereinbefore was described.

Figure 4:
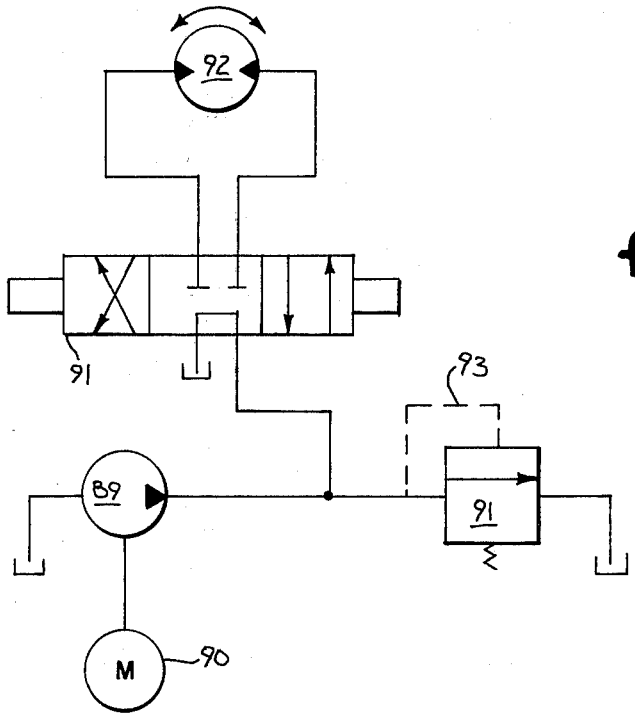
FIG. 4 is a schematic diagram of a hydraulic door operator constituting a third embodiment of the present invention.

FIG. 4 illustrates a third embodiment of the present invention, and includes a uni-directional pump 89 driven by an electric motor 90, a pressure relief valve 91 connected to the outlet side of the pump 89, an electrically actuated cross over shuttle valve 91 and a rotary hydraulic motor 92. The pressure relief valve 91 is connected to the outlet side of the pump 89 to sense the pressure of the system by means of a pilot line 93. If pressure is above a predetermined valve, the valve 91 opens to reduce the initial peak pressure surge of the pump 89 which occurs when the pump 89 is started up so that there is not a sudden surge of hydraulic fluid in the system. This permits smoother start-up for the door movement.

The electrically actuated cross over shuttle valve 91 is preferrably a solenoid valve which will be moved to the left, as shown in FIG. 4, to permit hydraulic fluid to turn the hydraulic motor 92 in one direction to either open or close the door 3, and may be moved to the right to permit the motor 92 to turn in the opposite direction. When in its neutral position, the solenoid valve 91 acts as a check valve or lock mechanism preventing the motor 92 from rotating, and thus preventing the door 3 from being moved when the pump 89 is not in operation. It should further be noted that the electric motor 90 may be controlled by an electric control circuit which is similar to the one described in FIG. 2, but appropriately modified. For example, it would not be necessary to include that portion of the control circuit of FIG. 2 which controls reversing the phase of the electric motor 90 since the pump 89 is uni-directional.

FIG. 5 illustrates a fourth embodiment of the present invention, and includes an electric motor 94 for driving a reversible hydraulic pump 95 which in turn drives a reversible hydraulic motor 96 through a closed loop hydraulic circuit. The fourth embodiment is similar to the first embodiment of FIG. 1 in that it includes a pair of control lines 97 and 98 to which are connected a pair of hydraulic input lines 99 and 100, respectively. The input lines 99 and 100 lead from a sump and are connected to the control lines 97 and 98 on either side of the pump 95. Disposed in the input lines 99 and 100 is a pair of check valves 101 and 102, respectively, which permit the replacement of hydraulic fluid from the sump to the control lines 97 and 98.

FIG. 5 also shows a pair of adjustable pressure relief valves 103 and 104 connected to the control lines 97 and 98. The valve 103 is connected to control line 97 by a line 105, and the valve 104 is connected to control line 98 by a line 106. The valves 103 and 104 include pilot lines 107 and 108, respectively, which sense the pressure in control lines 97 and 98 through the lines 105 and 106. If the pressure in control lines 97 or 98 exceeds a predetermined value, the associated valve 103 or 104 opens to relieve the pressure by passing hydraulic fluid from control lines 97 or 98 to the sump until line pressure drops below the predetermined value. In this manner the initial peak pressure developed during start-up on the outlet side of the pump 95 is reduced to permit smooth acceleration for the door 3.

While several embodiments of the invention have been shown and described, various modifications are obviously possible without departure from the scope of the invention. Various types of electric motors, hydraulic pumps, hydraulic motors and valves might be substituted. Also, it is not imperative that the particular electric control circuit described herein be used with the door operator, but the arrangement shown in considered preferable because of its simplicity.

We claim:

1. A door operator having a hydraulic system for opening and closing a door, comprising:

a hydraulic pump for pumping fluid, an electric motor for rotating said pump;

an electric control circuit which activates said electric motor to rotate said pump in the appropriate direction;

a reversible hydraulic motor connected through hydraulic control lines with said pump to be driven thereby, said hydraulic control lines comprising a first line between a first side of said hydraulic pump and a corresponding side of said hydraulic motor and a second line between a second side of said hydraulic pump and a corresponding side of said hydraulic motor;

valve means in each of said hydraulic control lines between said hydraulic pump and said hydraulic motor that are normally closed to lock fluid in said hydraulic motor to block turning thereof;

a pilot line extending between each hydraulic control line and the valve means in the other hydraulic control line, whereby pump pressure in one control line opens the valve means in the other control line;

drive means driven by said hydraulic motor to open and close said door; and a pressure relief valve connected to said control lines for diverting fluid from said motor.

2. The door operator as described in claim 1 wherein said pump is a reversible hydraulic pump.

3. A door operator including a hydraulic system for opening and closing a door, comprising:

a hydraulic pump for pumping fluid;

an electric motor for rotating said pump;

an electric control circuit which activates said electric motor to rotate said pump in the appropriate direction;

a reversible rotary hydraulic motor;

control lines connecting said hydraulic motor with said pump comprising a first line between a first side of said hydraulic pump and a corresponding side of said hydraulic motor and a second line between a second side of said hydraulic pump and a corresponding side of said hydraulic motor;

drive means driven by said hydraulic motor to open and close said door;

check valves disposed in said control lines with a check valve on either side of said hydraulic pump;

a first pair of pressure relief valves one being connected to said control lines on either side of said pump between said pump and said check valves;

a second pair of relief valves connected to said control lines leading from said hydraulic motor which are normally closed, and which are responsive to pressure in the control lines joined with the hydraulic motor to relieve pressure in such lines; and a pilot line extending between each control line and a valve in the other control line whereby pump pressure in one control line opens a valve in the other control line.

4. The door operator as described in claim 3, wherein said second set of relief valves are connected in a parallel relationship with said hydraulic motor in said control lines.

5. The door operator as described in claim 3, wherein said second set of relief valves are connected in a parallel relationship with said check valves in said control lines.

6. The door operator as described in claim 3, wherein said pump is reversible.

7. A door operator including a hydraulic system for opening and closing a door, comprising:

a hydraulic pump for pumping fluid;

an electric motor for rotating said pump;

a reversible rotary hydraulic motor;

control lines connecting said hydraulic motor and said pump;

drive means driven by said hydraulic motor to open and close said door;

check valves disposed in said control lines with a check valve on either side of said hydraulic pump;

a first pair of pressure relief valves one being connected to said control lines on either side of said pump between said pump and said check valves;

a pair of cushion lock valves connected with said control lines to relieve high pressure in said control lines joined with said hydraulic motor; and an electrical control circuit for said electric motor comprising:

a double coil reversible line switch with contacts for reversing line connections to said electric motor;

a rotary cam switch turned in unison with movement of a door to be controlled and having two sets of contacts responsive to cam position;

a control relay with a pair of coils comprising: an unlatched coil for door closing, a latched coil for door opening, a double throw switch operated into one position by said unlatched coil and into another position by said latched coil; and a supplementary contact operated by said unlatched coil;

circuit connections joining one of said line switch coils to a voltage source through rotary cam contacts and said double throw switch when in one of its positions, and joining the other of said line switch coils to a voltage source through rotary cam contacts and said double throw switch in its other position; and a safety switch in connection with said supplementary contact to activate said latched coil upon operation of said safety switch.

8. The door operator as described in claim 7, wherein each of said cushion-lock valves includes means for sensing the pressure in said control lines between a check valve and said pump and also the pressure in said control lines at the pump discharge side.

9. In a door operator the combination comprising:

a reversible hydraulic pump;

a reversible hydraulic motor connected to said pump in a hydraulic loop;

a check valve in each side of said hydraulic loop;

a pair of start cushioning valves located on opposite sides of said pump to conduct fluid from said hydraulic loop upon excessive pressures developing in the loop during starting;

a pair of normally closed stop cushioning valves connected to said hydraulic loop on opposite side of said hydraulic motor responsive to loop pressure to open and conduct fluid from said hydraulic motor in response to loop pressure at the discharge side of the motor during stopping;

a pair of pilot lines each extending between one side of said hydraulic loop and a valve in the other side of said hydraulic loop; and an electric motor in driving connection to said hydraulic pump.

10. In a door operator the combination comprising:

a reversible hydraulic pump;

a reversible hydraulic motor connected to said pump in a hydraulic loop;

a pair of start cushioning valves located on opposite sides of said pump to conduct fluid from said hydraulic loop upon excessive pressures developing in the loop during starting;

a pair of normally closed stop cushioning valves connected to said hydraulic loop responsive to loop pressure to open and conduct fluid from said hydraulic motor in response to loop pressure at the discharge side of the motor during stopping;

an electric motor in driving connection to said hydraulic pump; and an electrical control circuit comprising:

a double coil reversible line switch with contacts for reversing line connections to said electric motor;

a rotary cam switch turned in unison with movement of a door to be controlled and having two sets of contacts responsive to cam position;

a control relay with a pair of coils comprising: an unlatched coil for door closing, a latched coil for door opening, a double throw switch operated into one position by said unlatched coil and into another position by said latched coil; and a supplementary contact operated by said unlatched coil;

circuit connections joining one of said line switch coils to a voltage source through rotary cam contacts and said double throw switch when in one of its positions, and joining the other of said line switch coils to a voltage source through rotary cam contacts and said double throw switch when in its other position; and a safety switch in connection with said supplementary contact to activate said latched coil upon operation of said safety switch.

11. In a door operator, the combination comprising:
a hydralic pump;
an electric motor for rotating said pump; and
an electric control circuit for said motor comprising;
a double coil reversible line switch with contacts for reversing line connections to said electric motor;
a rotary cam switch turned in unison with movement of a door to be controlled and having contacts responsive to cam position;
a control relay which includes an unlatched coil for a door closing, a latched coil for door opening, and a double throw switch operated into one position by said unlatched coil and into another position by said latched coil; and
circuit connections joining one of said line switch coils to a voltage source through rotary cam contacts and said double throw switch when in one of its positions, and joining the other of said line switch coils to a voltage source through rotary cam contacts and said double throw switch when in its other position.

12. In a door operator the combination comprising:
a hydraulic pump;
an electric motor in driving relation to said pump;
a reversible hydraulic motor;
hydraulic control lines between said hydraulic pump and said hydraulic motor connecting the pump and motor in a hydraulic loop;
control valving connected to said control lines on both sides of the hydraulic loop, such valving including a check valve on each side of the loop that normally blocks fluid flow from the hydraulic motor, and a stop cushion valve on each side of said hydraulic motor that also normally blocks fluid flow from the motor;
a pilot line extending between each side of said hydraulic loop and a valve on the opposite loop side to convey pump pressure to such valve; and
further pilot lines each between one side of said hydraulic motor and the stop cushion valve for the same side;
whereby each check valve and the cushion valve on the opposite side of the hydraulic motor being responsive to pressures at the output side of said pump and the outlet side of said hydraulic motor to open flow around said hydraulic loop in response to pumping pressure and to permit flow from said hydraulic motor after pumping ceases while motor discharge pressure is relatively high.

13. The door operator of claim 12 having a pair of cushion start valves connected to the opposite sides of said pump to relieve pressure during start-up of the pump.

14. The door operator of claim 13 having an electrical control circuit comprising:
a cam switch indicative of door position;
a reversing line switch for said electric motor;
a latching control relay controlling energization of said reversing switch; and
a manual switch for operating said latching control relay through contacts of said cam switch.

* * * * *

UNITED STATES PATENT AND TRADEMARK OFFICE

CERTIFICATE OF CORRECTION

PATENT NO. : 4,296,570

DATED : October 27, 1981

INVENTOR(S) : George C. Balbach and Robert J. Peterman

It is certified that error appears in the above—identified patent and that said Letters Patent is hereby corrected as shown below:

| | | |
|---|---|---|
| Column 2, | line 26, | "in" should be ---is--- |
| Column 5, | line 52, | "electic" should be ---electric--- |
| Column 7, | line 66, | delete "the" |
| Column 10, | line 29, | "in" should be ---is--- |
| Column 11, | line 38, | "and" should be ---with--- |
| Column 12, | line 22, | "side" should be ---sides--- |
| Column 13, | line 10, | delete "a" |

Signed and Sealed this

*Second* Day of *February 1982*

[SEAL]

*Attest:*

GERALD J. MOSSINGHOFF

*Attesting Officer*

*Commissioner of Patents and Trademarks*